US007736202B1

(12) United States Patent
Kaiser et al.

(10) Patent No.: US 7,736,202 B1
(45) Date of Patent: Jun. 15, 2010

(54) CONTACT ASSEMBLY FOR ATTACHMENT TO AN ELECTRONICS MODULE

(75) Inventors: Edward L. Kaiser, Orion, MI (US); Ryan Van Tiem, Rochester Hills, MI (US); Michael H Standing, Canton, MI (US); David A Galey, Saint Croix, IN (US); Mark A. Adams, Jeffersonville, IN (US); Arthur L. McGrew, Jr., Indianapolis, IN (US)

(73) Assignee: GM Global Technology Operations, Inc., Detroit, MI (US)

( * ) Notice: Subject to any disclaimer, the term of this patent is extended or adjusted under 35 U.S.C. 154(b) by 0 days.

(21) Appl. No.: 12/353,419

(22) Filed: Jan. 14, 2009

(51) Int. Cl.
*H01R 13/24* (2006.01)

(52) U.S. Cl. ..... 439/824

(58) Field of Classification Search ..... 439/824, 439/817, 700
See application file for complete search history.

(56) References Cited

U.S. PATENT DOCUMENTS 4,904,213 A * 2/1990 Hock et al. ..... 439/824
5,009,613 A * 4/1991 Langgard et al. ..... 439/482
5,899,753 A * 5/1999 Wong et al. ..... 439/17

* cited by examiner

*Primary Examiner*—Javaid Nasri
(74) *Attorney, Agent, or Firm*—Quinn Law Group, PLLC

(57) ABSTRACT

A power electronics module includes an electronics module and a connector housing. The electronics module includes at least one interface section having at least one conductive surface. At least one connector is configured for attachment to the electronics module to establish electrical communication between the connector and the electronics module. The connector includes a connector housing, an insulative housing, a terminal and a biasing device. The insulative housing is supported by the connector housing. The terminal is configured to transmit electrical current to the conductive surface of the electronics module. The biasing device is configured to bias the terminal in a first direction to establish electrical contact with the conductive surface and the conductive surface biases the terminal in a second direction, opposite the first direction.

14 Claims, 3 Drawing Sheets

CONTACT ASSEMBLY FOR ATTACHMENT TO AN ELECTRONICS MODULE

TECHNICAL FIELD

The present invention relates to a contact assembly for attachment to an electronics module.

BACKGROUND OF THE INVENTION

It is typical for a plurality of electrical connections to be made to a single component inside of a vehicle. To do this, a number of individual connectors are used. These individual connectors typically equal the total number of electrical connections. To ensure the connection remains secure and connected, each connector may be individually fastened.

For example, in some hybrid transmissions each electrical connection requires an individual fastener. In addition, an individual cover is placed over each electrical connection, which may also require a seal. The excess of fasteners, seals, and covers increases the amount of time and expense required to assemble all of the electrical connections.

SUMMARY OF THE INVENTION

A contact assembly is configured for attachment to an electronics module. The contact assembly includes a terminal and a biasing device. The terminal is configured to transmit electrical current to the electronics module. A plunger is operatively disposed between the terminal and the biasing device. The biasing device is configured to bias the plunger and the terminal in a first direction to establish electrical contact with the electronics module.

A connector is configured for attachment to an electronics module. The connector includes an insulative housing and a contact assembly. The contact assembly is supported by the insulative housing and includes a terminal, a biasing device, and a plunger. The terminal is configured to transmit electrical current to the electronics module. The biasing device is configured to bias the terminal in a first direction to establish electrical contact with the electronics module. The plunger is movably disposed between the terminal and the biasing device.

A power electronics module includes an electronics module and a connector housing. The electronics module includes at least one interface section having at least one conductive surface. At least one connector is configured for attachment to the electronics module to establish electrical communication between the connector and the electronics module. The connector includes a connector housing, an insulative housing, a terminal and a biasing device. The insulative housing is supported by the connector housing. The terminal is configured to transmit electrical current to the conductive surface of the electronics module. The biasing device is configured to bias the terminal in a first direction to establish electrical contact with the conductive surface and the conductive surface biases the terminal in a second direction, opposite the first direction.

The above features and advantages and other features and advantages of the present invention are readily apparent from the following detailed description of the best modes for carrying out the invention when taken in connection with the accompanying drawings.

BRIEF DESCRIPTION OF THE DRAWINGS

Referring now to the figures, which are exemplary embodiments and wherein like elements are numbered alike.

DESCRIPTION OF THE PREFERRED EMBODIMENTS

Figure 1:
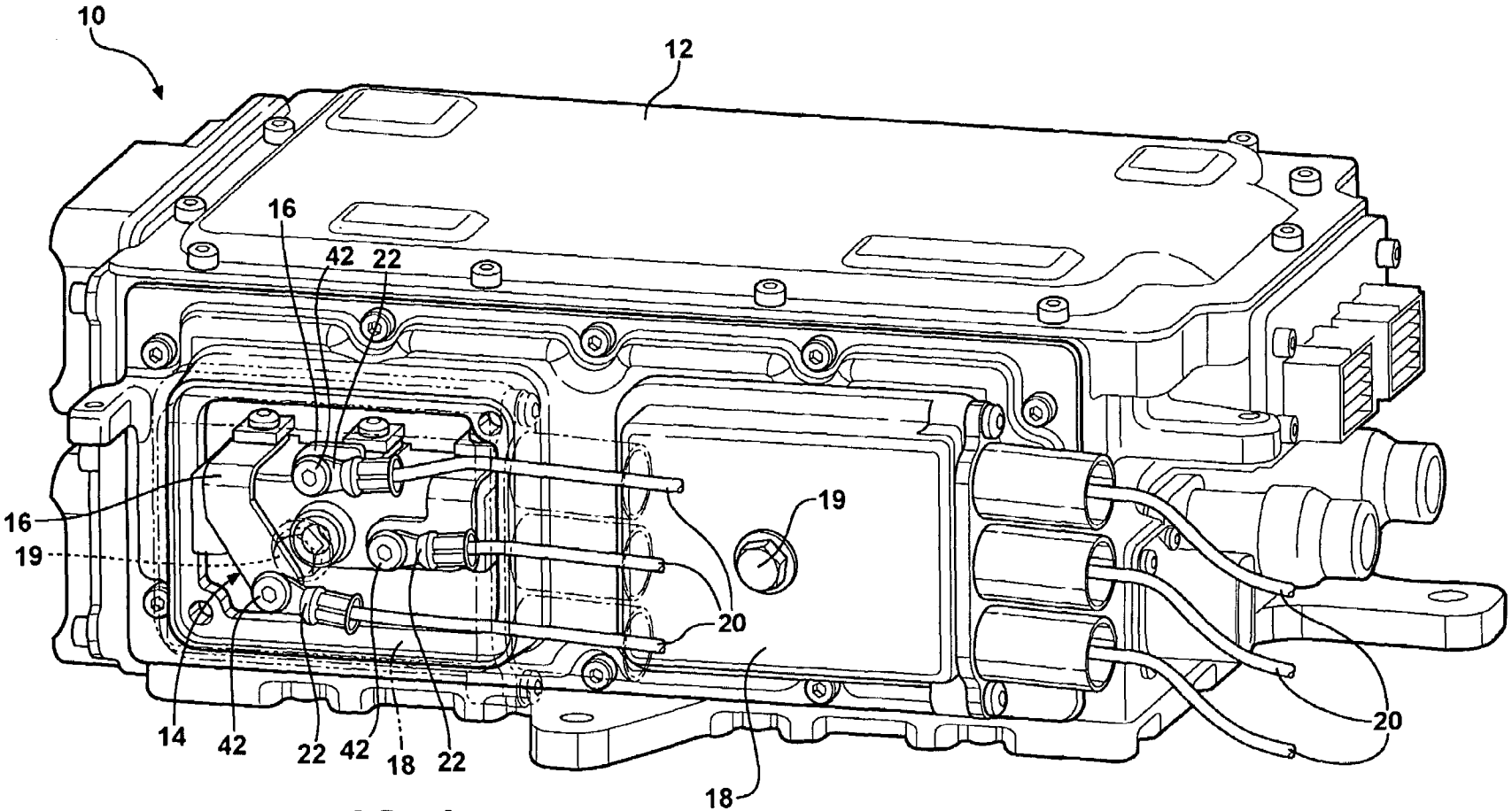
FIG. 1 is a partially cut-away perspective view of a power electronics module (PEM) having an electronics module and a plurality of connectors attached to the housing.

Referring to the drawings, wherein like reference numbers refer to like components, FIG. 1 shows a power electronics module (PEM) at 10. The PEM 10 may be used as a power inverter and charging system that converts DC power to AC power for a hybrid transmission (not shown). However, it should be appreciated that the PEM 10 may be used to create any other type of electronic interface between any other components known to those skilled in the art.

Referring again to FIG. 1, the PEM 10 includes an electronics module 12 that may include electric circuitry (not shown). The electronics module 12 may be configured for electrical attachment to the hybrid transmission and the like. The electronics module 12 may include one or more interface sections 14. Each interface section includes one or more conductive surfaces 16 disposed therein. The conductive surfaces 16 may be bus bars and the like. Referring again to the embodiment shown in FIG. 1, the PEM 10 includes two interface sections 14. The interface sections 14 may each include three conductive surfaces 16. However, it should be appreciated that more or less interface sections 14 and conductive surfaces 16 may be used as known to those skilled in the art.

A connector housing 18 is configured to mount over a respective interface section. Each connector housing 18 mates with electrical cables 20 that are equal to the number of conductive surfaces 16 in the corresponding interface section. The connector housing 18 includes a plurality of terminals 22 that are also equal to the number of conductive surfaces 16 disposed in the corresponding interface section. Each terminal 22 is adapted to extend from the respective electrical cable 20 such that each electrical cable 20 provides electric current to the terminal 22. Referring to the embodiments shown in the Figures, there are a total of three electrical cables 20 and three terminals 22 for each connector housing 18. It should be appreciated that more or less electrical cables 20 and terminals 22 may be used as known to those skilled in the art. A single fastener 19 may be used to attach the connector housing 18 to the housing and to place each terminal 22 in electrical communication with the corresponding conductive surface 16. Therefore, by including a plurality of terminals 22, i.e., three, within a single connector housing 18 that extend from an equal number of electrical cables 20, three electrical connections may be made between the electrical cables 20 and the housing by attaching the connector housing 18 to the electronics module 12.

When the connector housing 18 is attached to the electronics module 12, a contact assembly 21 ensures that adequate electrical communication between the electrical cables 20 and the conductive surfaces 16 is established. The contact assembly 21 includes a terminal that is biased toward the respective conductive surface 16 to ensure that the terminal 22 is in adequate contact with the respective conductive surface 16. The contact assembly 21 also includes a biasing device 24 that is disposed between each terminal 22 and the connector housing 18. The biasing device 24 may be a spring, i.e., a coil spring 24 and the like. It should be appreciated, however, that other biasing devices 24 known to those skilled in the art may also be used.

Each electrical cable 20 may extend into the connector housing 18. The connector housing 18 may be formed from aluminum and an insulative housing 26 is disposed inside the connector housing 18, as shown in FIGS. 2-5. The insulative housing 26 may be formed from an insulative material such as nylon and the like. The insulative housing 26 insulates conductive surfaces such as the terminal 22, the conductive surfaces 16, the electrical cables 20, and the like. In addition, the insulative housing 26 is configured to capture and support the electrical cables 20, the terminals 22, and the biasing devices 24. The insulative housing 26 includes a base 28 that is configured for supporting the biasing devices 24 and the terminals 22. The biasing devices 24 may be disposed between the base 28 and the respective terminals 22.

Figure 2:
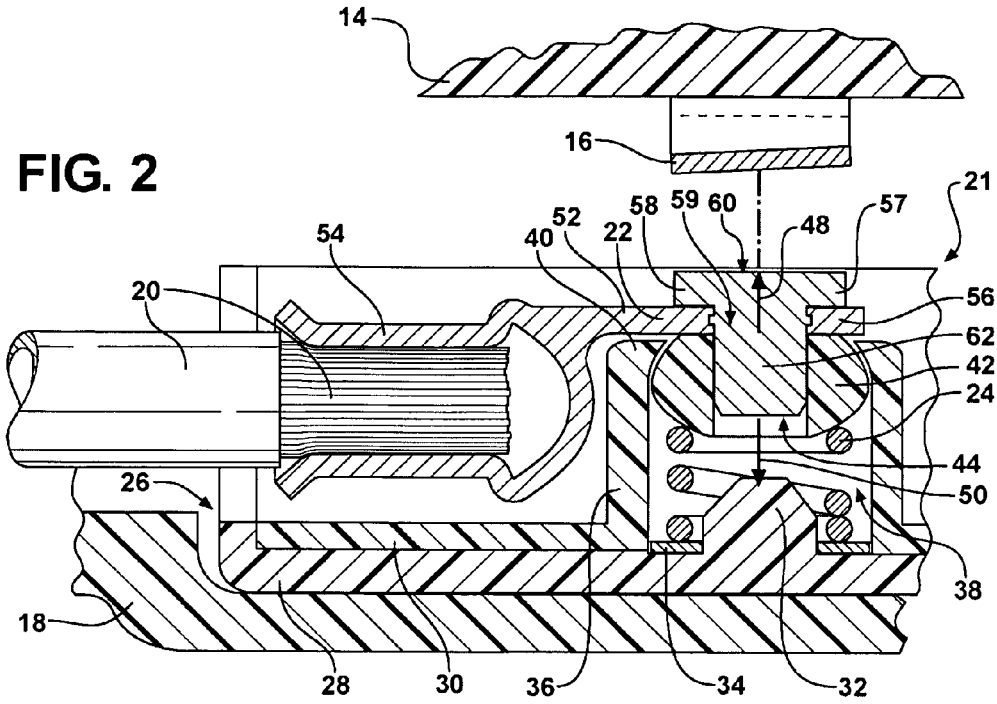
FIG. 2 is a schematic cross-sectional side view of the connector and a conductive surface of the electronics module not contacting a terminal of the connector.
Figure 3:
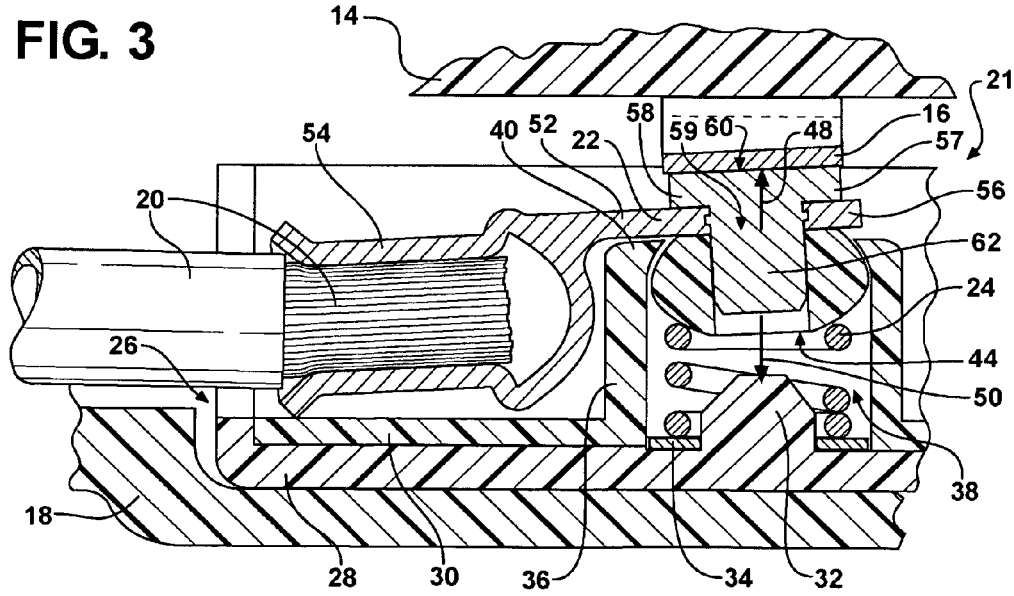
FIG. 3 is a schematic cross-sectional side view of the connector of FIG. 2 showing the conductive surface in contact with the terminal of the connector.

In one embodiment, shown in FIGS. 2 and 3, the insulative housing 26 may include a base 28 and a cover plate 30. A plurality of protrusions 32 extend from the base 28. A washer 34 may be disposed on the base 28 such that each washer 34 surrounds the respective protrusion 32. The washer 34 may be insert-molded onto the base 28 or disposed on the base 28 after the insulative housing 26 is formed. In this embodiment, the biasing device 24 is the coil spring 24. The coil spring 24 is supported by the base 28 and is disposed over the protrusion 32. The protrusion 32 functions to keep the coil spring 24 positioned on the base 28. The washer 34 may dissipate spring force of the coil spring 24 on the base 28. The contact assembly 21 may also include a plunger 42 that is disposed on the coil spring 24. The plunger 42 is spherical shaped and defines a channel 44 extending therethrough. The plunger 42 is configured to support the terminal 22 and the spherical shape of the plunger 42 allows the plunger 42 to pivot the terminal 22 into contact with the respective conductive surface 16. The plungers 42 may be formed from brass or any other suitable material known to those skilled in the art. The cover plate 30 may include a plurality of tubular projections 36. Each tubular projection 36 extends about a socket 38 to an end. A lip 40 extends inward to at least partially surround the channel 44. The cover plate 30 may be disposed over the base 28 such that the washers 34, the coil springs 24, and the plungers 42 are disposed in the sockets 38 of the respective tubular projections 36. The lip 40 of each tubular projection 36 retains the plunger 42 within the socket 38 of the respective tubular projection 36 while also allowing the plunger 42 to pivot relative to the spring and the tubular projection 36. The coil spring 24 biases the plunger 42 away from the base 28 in a first direction 48. Conversely, when the connector housing 18 is attached to the electronics module 12, the conductive surface 16 biases the respective terminal 22 in a second direction 50, opposite the first direction 48.

The terminal 22 may be formed from copper and the like. Referring again to FIGS. 2 and 3, the terminal 22 may include a contact section 52 and a barrel section 54 extending from the contact section 52. The barrel section 54 is configured to mate with the corresponding electrical cable 20 such that the electrical cable 20 is in electrical communication with the terminal 22. The contact section 52 is configured to contact the corresponding conductive surface 16. The contact section 52 includes a ring terminal 56 extending from the barrel section 54. A button 57 may be press fit through a hole 59 defined in the ring terminal 56. The button 57 includes a head 58 and a pin 62 extending from the head 58. After the button 57 extends through the ring terminal 56, the head 58 may be disposed on one side and the pin 62 may extend through the hole 59 and away from the ring terminal 56. The head 58 may present a contact surface 60 that is generally planar. The pin 62 is configured to extend into the channel 44 to engage the plunger 42. The pin 62 may be press-fit into the channel 44. However, other forms of engagement between the plunger 42 and the terminal 22 may also be used as known to those skilled in the art. As the connector housing 18 is attached to the electronics module 12, the contact surface 60 of the terminal 22 contacts the conductive surface 16. The conductive surface 16 biases the respective terminal 22 and the associated plunger 42 in the second direction 50 and allows the plunger 42 to pivot the terminal 22 into a generally flush contact with the conductive surface 16. Therefore, the pivoting and biasing of each plunger 42 allows the respective terminals 22 to establish flush and firm contact between the respective conductive surfaces 16 even when the conductive surfaces 16 are out of plane with one another.

Figure 4:
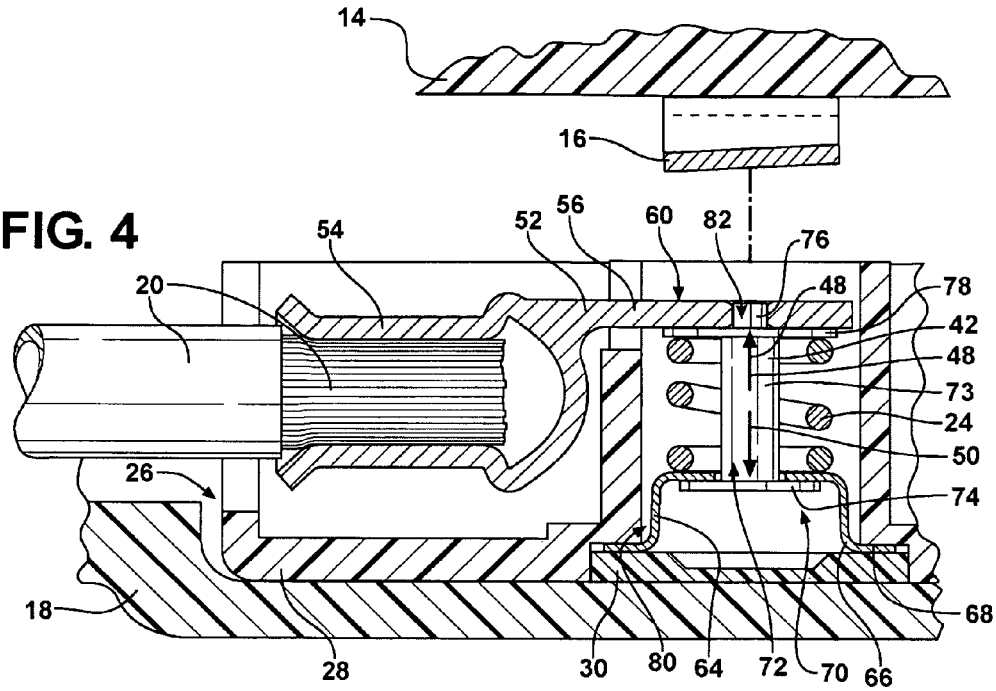
FIG. 4 is a schematic cross-sectional side view of an alternative embodiment of the connector with the conductive surface of the electronics module not contacting the terminal of the connector.
Figure 5:
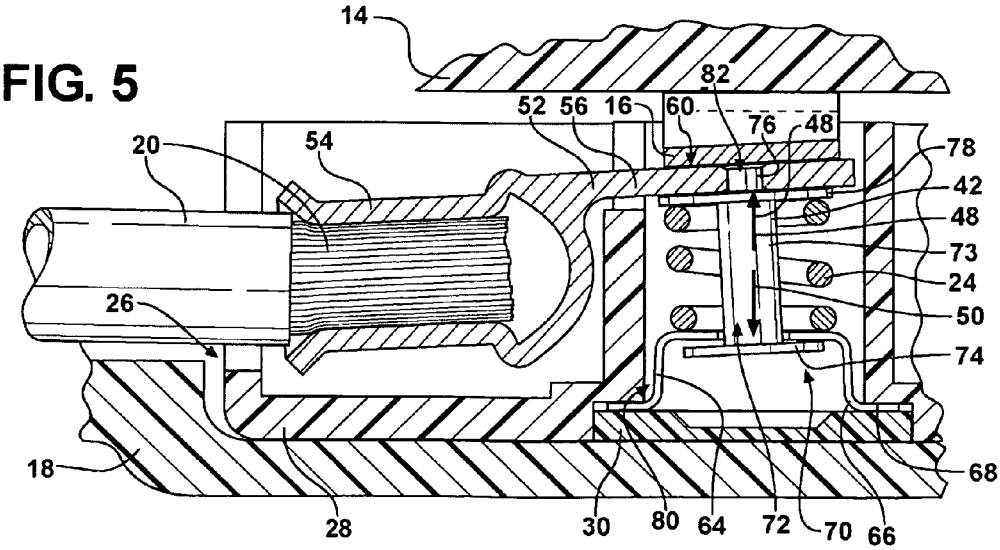
FIG. 5 is a schematic cross-sectional side view of the alternative embodiment of the connector of FIG. 4 showing the conductive surface in contact with the terminal of the connector.

In another embodiment, shown in FIGS. 4 and 5, the insulative housing 26 may include a base 28 and a cover plate 30. A retainer 64 may be disposed on the base 28 to correspond with the number of corresponding conductive surfaces 16. The retainer 64 may be generally dome shaped and extend about a cavity 70 to a supporting edge 66. A ledge 68 may extend outwardly away from the supporting edge 66. The retainer 64 defines an opening 72. The retainer 64 is oriented such that the ledge 68 is disposed on the base 28 and surrounds the cavity 70. In this embodiment, the biasing device 24 is the coil spring 24 that biases the plunger 42 away from the base 28 in the first direction 48. The coil spring 24 defines an opening 72 that extends therethrough. A plunger 42 extends through the opening 72 of the coil spring 24 and the opening 72 of the retainer 64. The plunger 42 includes a shaft 73. A flange 74 may extend radially outward from the shaft 73. The flange 74 and a portion of the shaft 73 are disposed within the cavity 70 of the retainer 64 such that the flange 74 engages the retainer 64 to limit the travel of the plunger 42 as the plunger 42 moves in the first direction 48, away from the base 28. The plunger 42 also includes a nub 76 extending in spaced relationship to the flange 74. A collar 78 may also extend radially outward from the shaft 73 in spaced relationship to the flange 74. The nub 76 is configured to mate with the terminal 22 and the collar 78 is configured to support the terminal 22 as the terminal 22 is biased toward the respective conductive surface 16. The cover plate 30 may define a plurality of orifices 80 that correspond to the number of retainers 64. When the cover plate 30 is placed over the base 28, each retainer 64 extends through the respective orifice 80. As a result, the ledge 68 of the retainer 64 is trapped between the cover plate 30 and the base 28. The coil spring 24 biases the plunger 42 away from the base 28 in a first direction 48. Conversely, when the connector housing 18 is attached to the electronics module 12, the conductive surface 16 biases the respective terminal 22 in the second direction 50, opposite the first direction 48.

In this embodiment, shown in FIGS. 4 and 5, the terminal 22 may include the contact section 52 and the barrel section 54 extending from the contact section 52. The contact section 52 presents the contact surface 60. The contact surface 60 is configured to contact the corresponding conductive surface 16. The contact section 52 defines a void 82. The contact section 52 may be pressed onto the plunger 42 such that the collar 78 supports the contact section 52 and the nub 76 extends into the void 82. However, other forms of engagement between the plunger 42 and the terminal 22 may also be used as known to those skilled in the art. As the connector housing 18 is attached to the electronics module 12, the contact surface 60 of the terminal 22 contacts the conductive surface 16. The conductive surface 16 biases the respective terminal 22 and the associated plunger 42 in the second direction 50, away from the conductive surface 16. Therefore, the biasing of each plunger 42 allows the respective terminals 22 to establish contact between the respective conductive surfaces 16.

While the best modes for carrying out the invention have been described in detail, those familiar with the art to which this invention relates will recognize various alternative designs and embodiments for practicing the invention within the scope of the appended claims.

The invention claimed is:

1. A contact assembly configured for attachment to a bus bar of an electronics module, said contact assembly comprising:

a terminal presenting a contact surface that is configured to transmit electrical current to the electronics module;

a biasing device; and a plunger operatively disposed between said terminal and said biasing device;

wherein said biasing device is configured to bias said plunger and said terminal in a first direction to establish electrical contact with the bus bar of the electronics module as the bus bar biases said terminal in a second direction, opposite said first direction, such that said contact surface of said terminal establishes flush contact with the bus bar.

2. A contact assembly, as set forth in claim 1, wherein said biasing device is a spring.

3. A contact assembly, as set forth in claim 2, wherein said spring is a coil spring.

4. A contact assembly, as set forth in claim 3, further comprising a washer wherein said biasing device is disposed between said plunger and said washer such that said washer is configured to dissipate spring force of said biasing device.

5. A contact assembly, as set forth in claim 1, wherein said terminal defines a hole such that said terminal mates with said plunger.

6. A contact assembly, as set forth in claim 5, wherein said plunger defines a channel extending therethrough and said terminal includes a pin extending into said channel.

7. A contact assembly, as set forth in claim 6, wherein said plunger is configured to be pivoted by the bus bar as the bus bar biases said terminal and said plunger in the second direction such that said contact surface of said terminal pivots with said plunger to establish flush contact between said contact surface and the bus bar.

8. A contact assembly, as set forth in claim 7, wherein said plunger is generally spherical.

9. A contact assembly, as set forth in claim 7, wherein said terminal includes a button having:

a head presenting said contact surface; and a pin extending from said head and through said hole and into said plunger;

wherein said contact surface is generally planar such that flush contact is established between said contact surface of said head and said bus bar as the bus bar biases said terminal and said plunger in the second direction.

10. A contact assembly, as set forth in claim 5, wherein said terminal defines an orifice and said plunger includes a nub extending into said hole.

11. A contact assembly, as set forth in claim 10, further comprising a retainer extending about a cavity to a supporting edge and defining an aperture opening into said cavity;

wherein said plunger extends through said aperture of said retainer such that said plunger is engaged by said retainer to limit travel of said plunger in said first direction.

12. A contact assembly, as set forth in claim 11, wherein said plunger includes a shaft and a flange extending radially outward from said shaft;

wherein said flange and a portion of said shaft are disposed within said cavity such that said flange is engaged by said retainer to limit travel of said plunger in said first direction.

13. A contact assembly, as set forth in claim 12, further comprising a collar extending radially outward from said shaft;

wherein said nub mates with said terminal;

wherein said collar supports said terminal

14. A contact assembly, as set forth in claim 13, wherein said biasing device is disposed between said terminal and said retainer.

* * * * *